US010612235B2

(12) United States Patent
Pues

(10) Patent No.: US 10,612,235 B2
(45) Date of Patent: Apr. 7, 2020

(54) ENERGY WALL STUD MEMBER AND CONSTRUCTION SYSTEM

(71) Applicant: Jon Pues, Bloomington, MN (US)

(72) Inventor: Jon Pues, Bloomington, MN (US)

( * ) Notice: Subject to any disclaimer, the term of this patent is extended or adjusted under 35 U.S.C. 154(b) by 0 days.

(21) Appl. No.: 16/240,656

(22) Filed: Jan. 4, 2019

(65) Prior Publication Data

US 2019/0203463 A1 Jul. 4, 2019

Related U.S. Application Data

(60) Provisional application No. 62/613,603, filed on Jan. 4, 2018.

(51) Int. Cl.

| | |
|---|---|
| ***E04B 2/00*** | (2006.01) |
| ***E04B 2/76*** | (2006.01) |
| ***E04B 2/74*** | (2006.01) |
| ***E04C 3/07*** | (2006.01) |
| ***E04B 2/70*** | (2006.01) |
| ***E04C 3/36*** | (2006.01) |
| ***E04C 3/32*** | (2006.01) |
| *E04C 3/04* | (2006.01) |

(52) U.S. Cl.

CPC ..... *E04B 2/767* (2013.01); *E04B 2/707* (2013.01); *E04B 2/7409* (2013.01); *E04B 2/7412* (2013.01); *E04B 2/7457* (2013.01); *E04C 3/07* (2013.01); *E04C 3/32* (2013.01); *E04C 3/36* (2013.01); *E04B 2002/7488* (2013.01); *E04C 2003/0443* (2013.01)

(58) Field of Classification Search

CPC ..... E04B 2/767; E04B 2/7457; E04B 2/7409

USPC ..... 52/481.1

See application file for complete search history.

(56) References Cited

U.S. PATENT DOCUMENTS

| | | | | |
|---|---|---|---|---|
| 4,434,579 A | 3/1984 | Murphy | | |
| 5,803,964 A | 9/1998 | Scarborough | | |
| 6,276,110 B1 * | 8/2001 | Karlsson | B27F 5/00 | 52/836 |
| 7,108,031 B1 * | 9/2006 | Secrest | B27M 1/003 | 144/1.1 |

(Continued)

FOREIGN PATENT DOCUMENTS

| | | | | |
|---|---|---|---|---|
| DE | 2003206117 * | 4/2003 | B66C 5/04 | |
| WO | WO-2018116316 A1 * | 6/2018 | E04B 2/7457 | |

*Primary Examiner* — Beth A Stephan

(74) *Attorney, Agent, or Firm* — Jose W. Jimenez; Jimenez Law Firm

(57) ABSTRACT

A vertical wall framing stud defines a vertical exterior-facing surface, a vertical interior-facing surface opposite the vertical exterior-facing surface and a long vertical side surface spanning between the vertical exterior-facing surface and the vertical interior-facing surface. A plurality of vertically spaced-apart cutouts can be defined into the vertical wall framing stud along the vertical exterior-facing surface. A ridge can be defined between an adjacent pair of the vertically spaced-apart cutouts. The ridge can include an exterior-facing planar surface that is vertically oriented. An exterior wall board can be fastened to the vertical exterior-facing surface of the vertical wall framing stud. An air gap is formed between each cutout and the inside-facing surface of the wall board. The air gap lowers the thermal bridging effect that occurs due to the framing stud being in contact with the exterior wall board.

19 Claims, 6 Drawing Sheets

(56) References Cited

U.S. PATENT DOCUMENTS

| | | | | |
|---|---|---|---|---|
| 7,698,858 | B2 | 4/2010 | Schroer | |
| 7,827,743 | B2 | 11/2010 | Campisi | |
| 8,820,034 | B1 * | 9/2014 | Watts | E04C 3/16 52/404.1 |
| 9,175,482 | B2 * | 11/2015 | Olma | E04F 13/0871 |
| 2005/0069674 | A1 * | 3/2005 | Chang | B32B 7/08 428/106 |
| 2008/0053035 | A1 * | 3/2008 | Rosenberg | E04B 2/7457 52/483.1 |
| 2008/0134619 | A1 * | 6/2008 | Nichols | E04B 5/48 52/690 |
| 2010/0058691 | A1 * | 3/2010 | Mannion | B32B 5/18 52/309.3 |
| 2014/0290175 | A1 * | 10/2014 | Klein | E04B 2/767 52/653.1 |
| 2017/0241144 | A1 * | 8/2017 | Schlyter Gezelius | E04F 13/10 |
| 2018/0112397 | A1 * | 4/2018 | Bertrand | E04B 1/2604 |
| 2018/0195282 | A1 * | 7/2018 | Pilz | E04B 2/7411 |

* cited by examiner

ENERGY WALL STUD MEMBER AND CONSTRUCTION SYSTEM

PRIORITY

This application claims the priority benefit of U.S. Provisional Application No. 62/613,603, filed on Jan. 4, 2018, which is hereby incorporated herein by reference in its entirety.

FIELD

The field of the invention is in wall framing and building construction in which wood studs are used to build walls and platforms.

BACKGROUND

One of the many challenges in home and building construction is energy consumption after the home or building is completed. An example of a conventional framed wall is illustrated in FIG. 1. A floor joist 10 has a subfloor 12 disposed atop the joist. A plurality of vertical wall studs 14 extend vertically between a horizontal top plate member 16 and a horizontal bottom plate member 18, thereby defining a wall frame. The wall frame is secured atop the subfloor 12 and joist 10. A wall board 20 is secured to the exterior side of the wall studs 14, top plate member 16 and bottom plate member 18.

Framed walls are usually given an energy rating. The higher the rating the more energy conserving the constructed wall is expected to be. A conventional wall system may have a nominal R-21 value, but the effective R-value is actually up to thirty percent (30%) less than the nominal value due to thermal bridging caused by the framing. This is because the wall framing members and studs serve as a "bridge" or "conductor" of heat through the wall. Thus, the temperature on the outside of the house is conducted through the wall via the physical contact that the frame members and studs have with the inner and outer walls. This results in a real-world reduction of the R factor of the wall well below its nominal value. For example, an R-21 rated wall only effectively has a value of R-16 using conventional materials and construction techniques.

A typical insulation upgrade offered by builders in order to offset the effects of thermal bridging and to increase the R factor rating of the framed wall is to spray foam insulation. Three (3) inches of spray foam will improve an R-16 rated wall to an R-21 rated wall, while a 5.5 inch thickness of spray foam (the depth of a 2×6 stud) will bring the R-16 rating up to an R-38 value. Another current attempted solution is to use a hybrid "flash and fill" or flash system. In the flash and fill system, the builder installs a two inch layer of spray foam and batt with fiberglass or fill with loose cellulous for the other 3.5 inches which raises the R-value to a stated R-30. However, neither of these current attempts to improve insulation values actually addresses the thermal bridging problem described above. Thus, even with these upgrades, the wall is still subject to the thirty percent thermal loss due to thermal bridging. For example, the "R-30" rated wall with the flash and fill upgrade only has an effective R-22 rating.

Therefore, there is a need for an energy wall stud member and wall framing solution that will cost-effectively and substantially reduce the effects of thermal bridging in walls that are in contact with outside building layers in a home or other structure.

SUMMARY

Various embodiments are disclosed herein that provide an improved wall framing system to give builders and home owners a cost effective and simple way to increase insulation values using standard wall framing techniques. The system provided herein removes unnecessary material from frame members to lower the contact surfaces where the frame member abuts the wall in order to reduce the surface area where thermal bridging can occur.

In one example, less surface area for thermal bridging can be achieved by hollowing out the wall studs and plates in the areas where the nails are not fastened to the wall sheathing. This also allows spray foam to expand into those hollowed out areas to provide a thermal break between the wall sheathing and the stud and plates. This configuration can substantially reduce the amount of thermal bridging in a given wall system. For example, instead of a 30 percent loss, the losses due to bridging can be kept to approximately ten percent. This is a significant improvement because the example R-30 wall would now only be reduced to R-27.

An additional advantage of the system and devices provided herein is the ability to use the gaps in the studs to more easily run electrical and low voltage conduit through framed walls.

Also, if the customer decides to fill the wall's interior cavity with spray foam there is a benefit of a structural improvement since there will be a greater surface area where the wall system is glued together by the spray foam.

This wall system provided herein can be used in all building regions. In contrast, conventional high R factor wall systems called the Extended Beam and Plate System that use 2×6 plates, 2×4 framing and 2 inches of ridged foam are not acceptable in high wind or seismic regions and also require special framing techniques.

The wall system provided herein can include an elongated wall frame member having a body including a plurality of apertures formed within and through the body, the apertures being located in series along a length of the elongated wall frame member. The wall system can further include an outer sheathing member configured to be attached to an outer surface of the wall frame member without covering the plurality of apertures.

Provided herein also is a vertical wall framing stud that defines a vertical exterior-facing surface, a vertical interior-facing surface opposite the vertical exterior-facing surface and a long vertical side surface spanning between the vertical exterior-facing surface and the vertical interior-facing surface. A plurality of vertically spaced-apart cutouts can be defined into the vertical wall framing stud along the vertical exterior-facing surface. A ridge can be defined between an adjacent pair of the vertically spaced-apart cutouts. The ridge can include an exterior-facing planar surface that is vertically oriented.

An exterior wall board can be fastened to the vertical exterior-facing surface of the vertical wall framing stud to define a wall structure. An air gap is formed between each cutout and the inside-facing surface of the wall board. The air gap lowers the thermal bridging effect that occurs due to the framing stud being in contact with the exterior wall board.

The vertical interior-facing surface can be a continuous planar surface.

The vertical wall framing stud can be an elongated singular body.

A series of vertically-elongated apertures are defined horizontally into and through the vertical wall framing stud.

The series of vertically-elongated apertures can be located along a midline of the long vertical side surface. Electrical conduit can be passed through one or more of the vertically-elongated apertures.

The cutouts can define a radiused surface. The cutouts can be vertically-sized such that a ridge of two inches vertical length is centered every six inches or twelve inches along the vertical exterior-facing surface. Other spacing dimensions can be provided as well.

Insulation can be disposed within or provided to the air gap. For example, the insulation can be an expanding spray foam or a fiberglass batt.

A fastener can be used to secure the exterior wall board to the vertical wall framing stud. The fastener extends through the wall board from the exterior-facing surface thereof and into the vertical wall framing stud at a vertical location aligned between the adjacent pair of the vertically spaced-apart cutouts such that the fastener penetrates the exterior-facing planar surface of the ridge.

The wall structure can be part of a building wherein a subfloor is disposed atop the floor joist, a horizontal top plate member is secured atop the vertical wall framing stud and the vertical wall framing stud is secured atop a horizontal bottom plate member. The horizontal bottom plate member can be secured atop the subfloor.

Further provided herein is a method of forming a building wall. The method can include defining a plurality of vertically spaced-apart cutouts into a vertical wall framing stud along the vertical exterior-facing surface thereof, defining a ridge between an adjacent pair of the vertically spaced-apart cutouts, the ridge including an exterior-facing planar surface that is vertically oriented, and securing a wall board to the vertical exterior-facing surface of the vertical wall framing stud so that an air gap is formed between each cutout and the inside-facing surface of the wall board. Insulation can be provided to the air gap.

The step of securing can include driving a fastener through the wall board from an exterior-facing surface thereof and into the vertical wall framing stud at a vertical location aligned between the adjacent pair of the vertically spaced-apart cutouts such that the fastener penetrates the exterior-facing planar surface of the ridge.

A series of vertically-elongated apertures can be defined horizontally into and through the vertical wall framing stud. Electrical conduit can be passed through these apertures.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 2A:
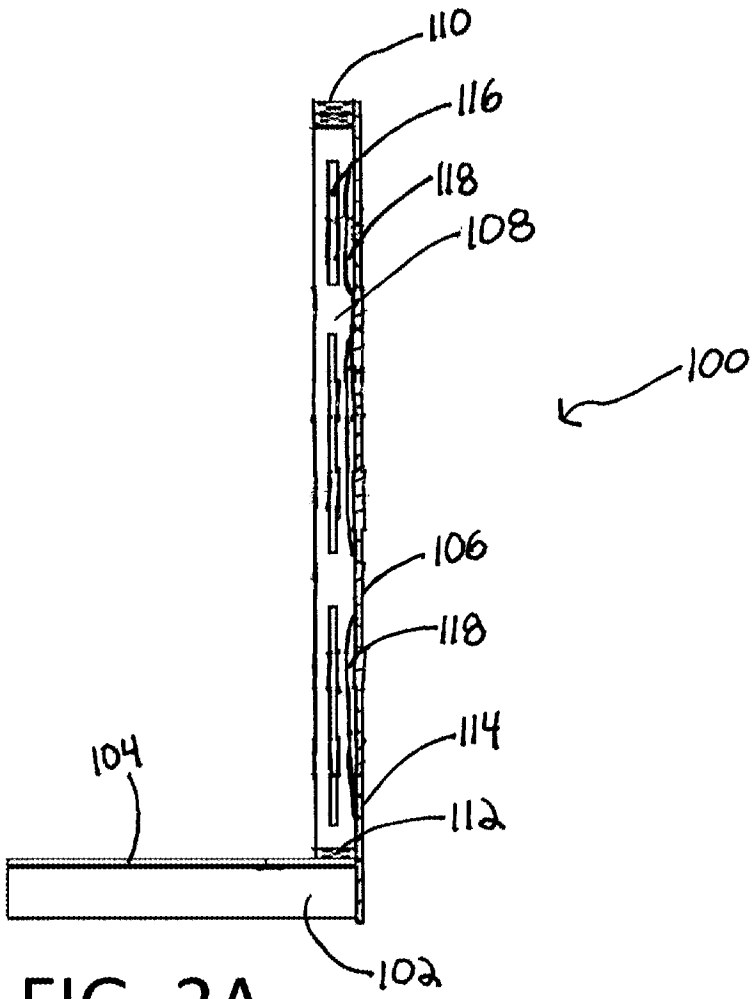
FIG. 2A is a side view of a wall system in accordance with the present invention.
Figure 1:
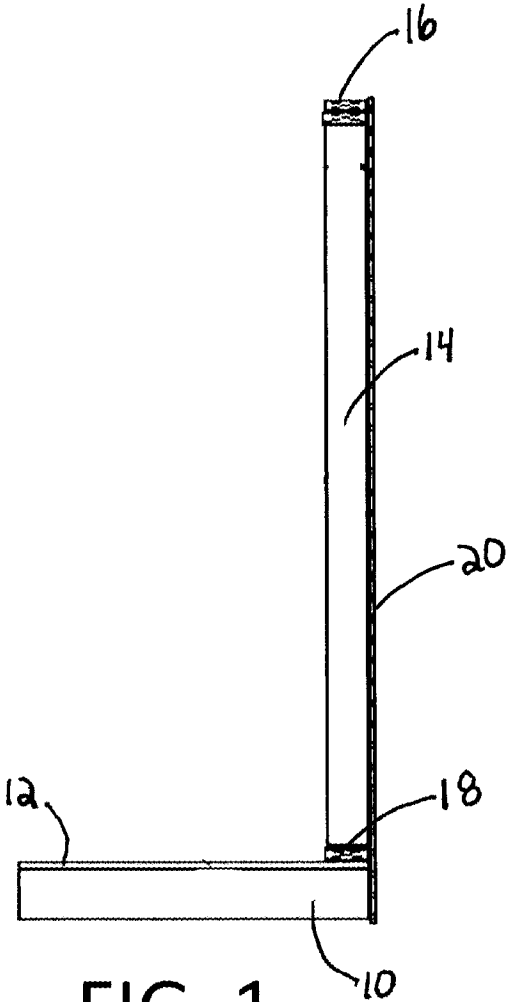
FIG. 1 (Prior Art)
FIG. 1 is a side view of a prior art wall system.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention.

Any dimensional information provided herein and indicated in the figures is for certain preferred embodiments. It should be recognized, however, that the dimensions, proportions, scale and configurations of components are merely example embodiments and can be varied unless specifically limited in a given claim. Thus, the dimensions, proportions, scale and configurations can be varied without departing from the scope of the invention except where explicitly limited by a given claim.

Referring to FIG. 2A, a wall system 100 is shown in side view as a wall cross-section. A conventional floor joist 102, subfloor 104 and exterior wall board 106 are provided as described previously. However, the vertical wall members or studs 108 used to form the wall frame have a unique configuration as will be discussed in detail below. Conventional horizontal top plate member 110 and a horizontal bottom plate member 112 are again used as in the conventional wall construction. The wall frame with the unique vertical wall studs is secured atop the subfloor 104 and joist 102. A conventional wall board 114 is secured to the exterior side of the vertical wall studs 108, top plate member 110 and bottom plate member 112.

Figure 2B:
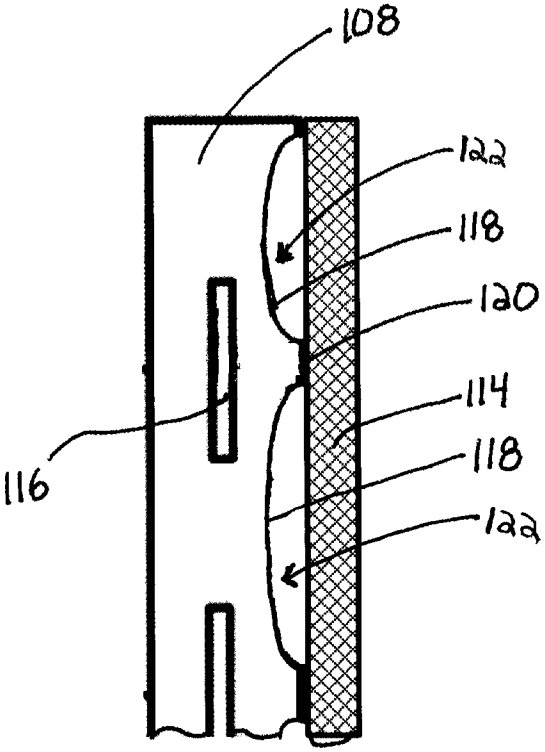
FIG. 2B is an enlarged partial view of the wall stud of FIG. 3A.

Referring additionally to FIG. 2B, the vertical wall studs comprise a singular body that includes a plurality of apertures 116 formed within and through the body from long side to long side. The apertures can be configured as vertically elongated rectangular slits aligned in series along the vertical midline of the vertical wall stud 108. Other aperture shapes such as ovals, ellipses, polygons, and complex shapes can alternatively be provided. The apertures 116 can also be omitted in certain embodiments.

The vertical wall studs further include one or more indents, notches or cutouts 118 disposed along the vertical length of the exterior-facing side surface of the vertical wall stud 108. The cutouts 118 define a plateau or ridge 120 between adjacent cutouts. The ridges 120 present a flat vertical surface segment to which the outer wall board (or other sheeting or substrate) can mate and be fastened to the vertical wall stud 108 in a conventional manner (e.g., nails, screws, etc.). An air gap 122 is defined in the area of the cutout between the vertical wall stud 108 and the inner surface of the wall board 114. Thus, the amount of surface contact between the exterior side of the vertical wall stud 108 and the wall board 114 is greatly reduced as compared to conventional vertical wall studs, wall systems and wall construction methods.

Cutouts 118 can also be provided to the inside side surface of the vertical wall stud in alternative embodiments.

Conventional fastener hardware, such as nails or screws, can be used to secure the wall board 114 to the vertical wall studs 114. The fasteners are preferably placed into the vertical wall studs 108 where the ridges 120 between adjacent cutouts 118 are located. The cutouts 118 are sized and spaced such that the ridges are defined where one would conventionally dispose fasteners in conventional wall systems.

The cutouts 118 can take any shape. However, in one example, the cutouts are radiused at their farthest extents or end portions and either have a planar center section therebetween or a center section with less curvature than the radiused end portions. Of course, the cutout can be rectangular, polygonal, complex or any various shape that defines the air gap 122 with the wall board 114.

In use, insulation or spray foam can be provided to the wall framing such that the insulation or foam extends into the air gaps 122 and apertures 116. For example, closed cell spray foam can be used to both gain insulation value and enhance overall wall strength. This occurs due to the polyurethane spray foam adhering to the vertical wall studs 108 and wall board 114. Since the foam has air gaps 122 and aperture slots 116 to expand into, the foam provides extra insulation value and also joins together the members of the entire wall system as a singular, and thus stronger, mass.

An inside wall board can be secured to the inside vertical side of the vertical wall stud 108.

The vertical wall studs 108 can also be used for the top and bottom plates in the wall framing in additional embodiments.

The apertures 116 are preferably vertically centered on the ridges. The apertures thus provide a thermal break for heat transfer horizontally through the stud from exterior to interior sides. The apertures 116 also can be conveniently used to pass electrical or other conduit (e.g. wires) horizontally through the wall framing. The horizontally centered placement of the apertures 116 thus maintains the conduit in an advantageously centered location within the finished wall.

Figure 3B:
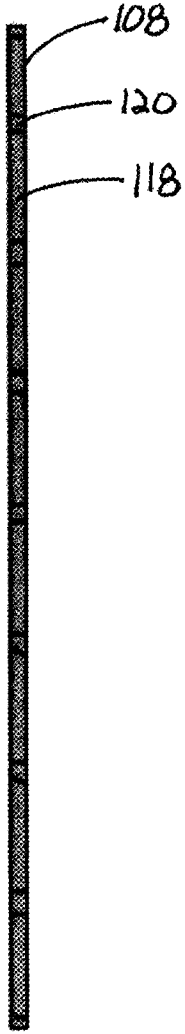
FIG. 3B is an exterior side view of a wall stud in accordance with the present invention.
Figure 3A:
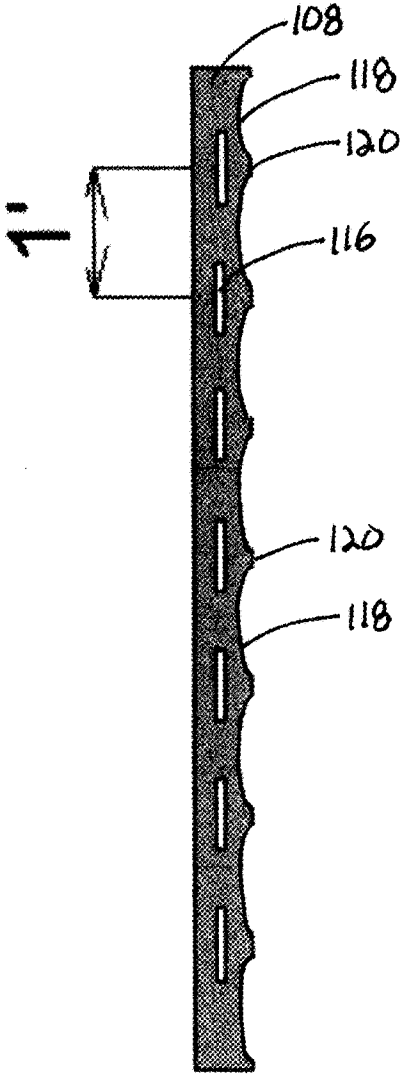
FIG. 3A is a long side view of a wall stud in accordance with the present invention.
Figure 7:
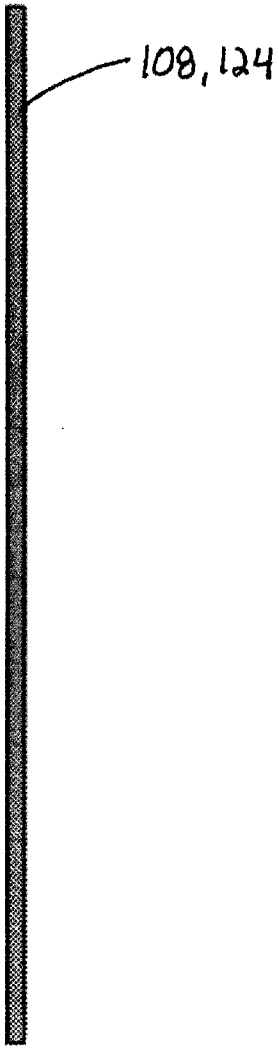
FIG. 7 is an opposing side view of a wall stud in accordance with the present invention.
Figure 6:
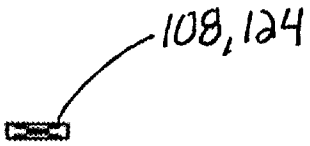
FIG. 6 is a top view of a wall stud in accordance with the present invention.

Referring now to FIGS. 3A-3B, one example embodiment of the vertical wall stud 108 is depicted. FIG. 3A shows the long side of the stud 108 and FIG. 3B shows the exterior side of the stud 108. FIGS. 6-7 show the top end and inside side views of the stud 108, respectively. The cutouts 118 are sized such that a ridge of two inches vertical length is centered every twelve inches along the vertical length of the stud 108. The cutouts can penetrate to a depth of one inch into the stud. However other depths can be provided and the depth can vary across the vertical length of the cutout.

Figure 4B:
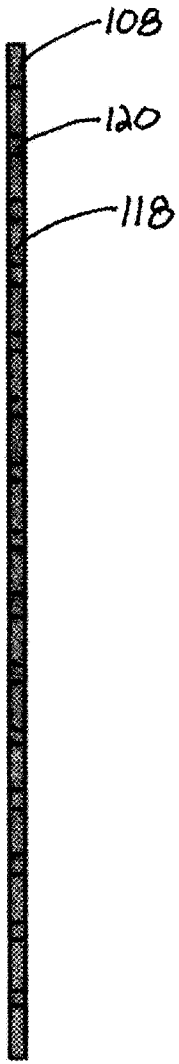
FIG. 4B is an exterior side view of a wall stud in accordance with the present invention.
Figure 4A:
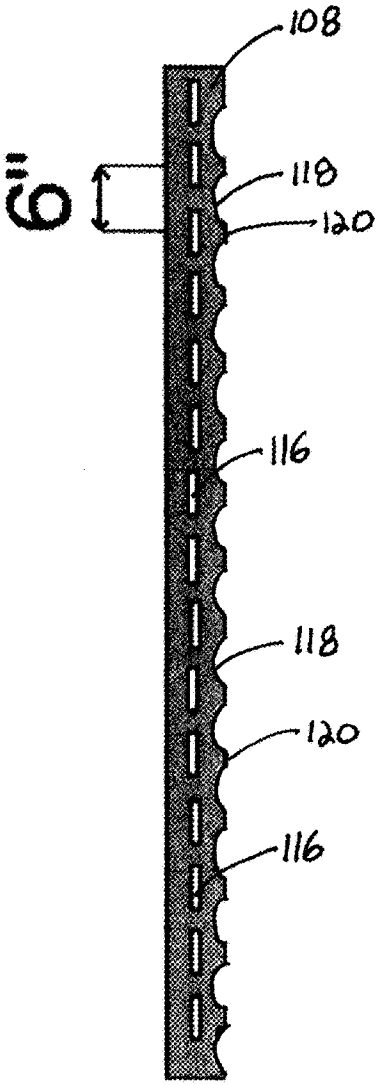
FIG. 4A is a long side view of a wall stud in accordance with the present invention.

Referring next to FIGS. 4A-4B, another example embodiment of the vertical wall stud 108 is depicted. FIG. 4A shows the long side of the stud 108 and FIG. 4B shows the exterior side of the stud 108. FIGS. 6-7 show the top end and inside side views of the stud 108, respectively. The cutouts 118 are sized such that a ridge of two inches vertical length is centered every six inches along the vertical length of the stud 108. The aperture 116 lengths are also adjusted proportionately to the cutouts. This embodiment increases the number of ridges for additional fastening positions and also provides a wider variety of conduit placements.

Figure 5B:
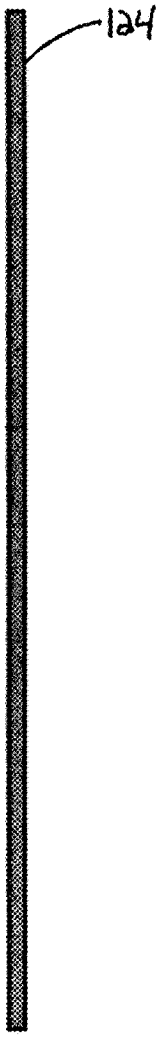
FIG. 5B is an exterior side view of a wall stud in accordance with the present invention.
Figure 5A:
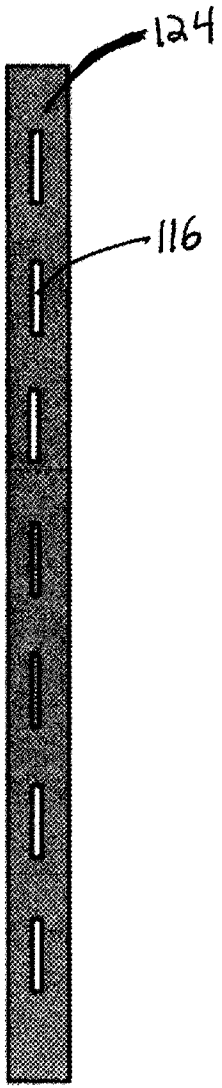
FIG. 5A is a long side view of a wall stud in accordance with the present invention.

Referring to FIGS. 5A-5B, an example embodiment of an interior wall vertical wall stud 124 is depicted. FIG. 5A shows the long side of the stud 124 and FIG. 5B shows the exterior side of the stud 124. FIGS. 6-7 show the top end and inside side views of the stud 124, respectively. There are no cutouts in this embodiment. Only the apertures 116 are provided to the stud body in this embodiment. Since there are no cutouts, there will be no air gaps 122 formed against the exterior wall board, so this stud configuration is best utilized for interior wall framing.

The inside side of the stud 108 or 124 is a planar vertical surface. The inside surface can be provided with cutouts 118 similar to the exterior side or in another different cutout configuration.

The stud body 108 or 124 according to any of the embodiments can be formed in any length and cross-sectional size. For example 2×6 and 2×8 sizes with lengths such as framing members in 92⅝ inches and 104⅝ inches, and standard lengths of 7, 8, 10, 12, 14 and 16 feet for wall plates.

The vertical wall studs 108 can be configured as field studs and perimeter studs, among others.

The vertical wall studs 108 can be formed of wood, including composite wood, engineered wood, and natural lumber. The studs can also be formed of other rigid materials suitable for construction such as metal (e.g. steel and aluminum), fiberglass, reinforced plastics and non-metal composites.

Conventional machinery can be used to form the cutouts 118, such as pallet notch forming machines. The cutouts 118 and apertures 116 can also be formed with conventional sawing machinery. The cutouts 118 and apertures 116 are preferably formed as part of the stud manufacturing process rather than on the construction site.

An advantage of the wall system and construction methods provided herein is the cost effective and simple way that insulation values for walls can be increased using conventional wall framing techniques. By removing material from the vertical studs and defining air gaps with the exterior wall boards, the thermal bridging effect between the studs and exterior walls is greatly reduced without adversely impacting the construction methods or the integrity of the wall framing. Plus, the air gaps and apertures provide for insulation to be introduced where not previously possible.

The following patents and publications are herein incorporated by reference in their entireties: U.S. Pat. Nos. 4,434,579; 5,803,964; 7,698,858; and 7,827,743.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A vertical wall framing stud, comprising:

an elongated singular body defining a vertical exterior-facing surface, a vertical interior-facing surface opposite the vertical exterior-facing surface and a long vertical side surface spanning between the vertical exterior-facing surface and the vertical interior-facing surface, wherein a series of vertically-elongated apertures are defined horizontally into and through and along the long vertical side surface of the elongated singular body;

wherein a plurality of vertically spaced-apart cutouts are defined into the elongated singular body along the vertical exterior-facing surface, and wherein a ridge is defined between an adjacent pair of the vertically spaced-apart cutouts, and the ridge defines an exterior-facing planar surface that is vertically oriented.

2. The vertical wall framing stud of claim 1, wherein the vertical interior-facing surface is a continuous planar surface.

3. The vertical wall framing stud of claim 1, wherein the series of vertically-elongated apertures are located along a midline of the long vertical side surface.

4. The vertical wall framing stud of claim 1, wherein the cutouts define a radiused surface.

5. The vertical wall framing stud of claim 1, wherein the vertical wall framing stud is a 2×6 stud or a 2×8 stud.

6. The vertical wall framing stud of claim 1, wherein the elongated singular body comprises wood.

7. The vertical wall framing stud of claim 1, wherein the cutouts are vertically-sized such that a ridge of two inches vertical length is centered every twelve inches along the vertical exterior-facing surface.

8. The vertical wall framing stud of claim 1, wherein the cutouts are vertically-sized such that a ridge of two inches vertical length is centered every six inches along the vertical exterior-facing surface.

9. A wall structure, comprising:

a vertical wall framing stud defining a vertical exterior-facing surface, a vertical interior-facing surface opposite the vertical exterior-facing surface and a long vertical side surface spanning between the vertical exterior-facing surface and the vertical interior-facing surface, wherein a plurality of vertically spaced-apart cutouts are defined into the vertical wall framing stud along the vertical exterior-facing surface, and wherein a ridge is defined between an adjacent pair of the vertically spaced-apart cutouts, and the ridge includes an exterior-facing planar surface that is vertically oriented; and an exterior wall board fastened to the vertical exterior-facing surface of the vertical wall framing stud, the exterior wall board including an inside-facing surface and an exterior-facing surface, wherein an air gap is formed between each cutout and the inside-facing surface of the wall board.

10. The wall structure of claim 9, further comprising insulation disposed within the air gap.

11. The wall structure of claim 10, wherein the insulation is an expanding spray foam.

12. The wall structure of claim 9, wherein a fastener extends through the wall board from the exterior-facing surface thereof and into the vertical wall framing stud at a vertical location aligned between the adjacent pair of the vertically spaced-apart cutouts such that the fastener penetrates the exterior-facing planar surface of the ridge.

13. The wall structure of claim 9, wherein a series of vertically-elongated apertures are defined horizontally into and through the vertical wall framing stud.

14. The wall structure of claim 13, wherein an electrical conduit is disposed through at least one of the vertically-elongated apertures.

15. The wall structure of claim 9, further comprising:

a floor joist;

a subfloor disposed atop the floor joist;

a horizontal top plate member secured atop the vertical wall framing stud; and a horizontal bottom plate member, wherein the vertical wall framing stud is secured atop the horizontal bottom plate member, and wherein the horizontal bottom plate member is secured atop the subfloor.

16. A method of forming a building wall, the method comprising:

defining a plurality of vertically spaced-apart cutouts into a vertical wall framing stud along a vertical exterior-facing surface thereof;

defining a ridge between an adjacent pair of the vertically spaced-apart cutouts, the ridge including an exterior-facing planar surface that is vertically oriented; and securing a wall board to the vertical exterior-facing surface of the vertical wall framing stud so that an air gap is formed between each cutout and an inside-facing surface of the wall board.

17. The method of claim 16, wherein the step of securing includes driving a fastener through the wall board from an exterior-facing surface thereof and into the vertical wall framing stud at a vertical location aligned between the adjacent pair of the vertically spaced-apart cutouts such that the fastener penetrates the exterior-facing planar surface of the ridge.

18. The method of claim 16, further comprising: proving insulation in the air gap.

19. The method of claim 16, further comprising defining a series of vertically-elongated apertures horizontally into and through the vertical wall framing stud.

* * * * *